US005214739A

United States Patent [19]

Nelson et al.

[11] Patent Number: 5,214,739

[45] Date of Patent: May 25, 1993

[54] LOCALIZED HEATING UNIT FOR DESKS

[76] Inventors: Thomas M. Nelson, 10923-89 Avenue; Per B. Arnt, 12368-132 Street, both of Edmonton, Alberta, Canada, T5L 1P8

[21] Appl. No.: 821,581

[22] Filed: Jan. 16, 1992

[51] Int. Cl.[5] ..... H05B 3/22

[52] U.S. Cl. ..... 392/432; 392/424; 392/430; 392/431; 392/436

[58] Field of Search ..... 392/432, 435, 433, 436, 392/422, 423, 424, 425, 430, 431, 437, 439, 376, 348

[56] References Cited

U.S. PATENT DOCUMENTS

| | | | |
|---|---|---|---|
| 2,032,622 | 3/1936 | Le Guillou . | |
| 2,479,425 | 8/1949 | Steingruber . | |
| 2,535,393 | 12/1950 | Daugert | 392/435 |
| 2,612,825 | 10/1952 | Walker . | |
| 2,613,308 | 10/1952 | Mirand . | |
| 2,678,372 | 5/1954 | Salton | 392/435 |
| 2,700,095 | 1/1955 | Needham | 392/436 |
| 2,715,668 | 8/1955 | Booker et al. . | |
| 3,309,500 | 3/1967 | Reynolds . | |
| 3,961,157 | 6/1976 | Miller et al. . | |
| 4,052,588 | 10/1977 | Nakamura et al. . | |

FOREIGN PATENT DOCUMENTS

| | | | |
|---|---|---|---|
| 162020 | 1/1949 | Austria | 392/425 |

*Primary Examiner*—Teresa J. Walberg

*Attorney, Agent, or Firm*—Shoemaker and Mattare, Ltd.

[57] ABSTRACT

A heating unit includes a frame and a substantially flat radiant heating surface supported by the frame. A generally parabolic trough with a reflective inner surface is mounted along one edge of the periphery of the heating surface, and contains an elongate heating element. Further, a reflective flap is hingedly mounted adjacent the trough but remote from the heating surface, disposed so that at least a portion of the radiant energy reflected out of the trough by the reflective inner surface is re-reflected by the flap, depending upon its angulation with respect to the heating surface.

12 Claims, 2 Drawing Sheets

LOCALIZED HEATING UNIT FOR DESKS

This invention relates generally to comfort heating for individuals in the work area, and has to do particularly with a radiant panel which can be utilized in the well of a typical desk.

BACKGROUND OF THIS INVENTION

Research conducted by one of us has confirmed that temperature sensors located in the forehead have an effect on heart rate. Cooler temperatures tend to slow the heart rate, whilst higher temperatures tend to increase the heart rate. It has been demonstrated that there is a connection between increased heart rate and feelings of exertion in office environments. Higher temperatures produce feelings of fatigue despite the amount of real effort being expended. Conversely, lower temperatures, particularly at the hands and feet, tend to create discomfort. Thus, an idealized ambience for a working environment is one which keeps the forehead cool (by maintaining a low ambient temperature) while at the same time providing warmth to the more sensitive areas of the body (hands and feet) to allow physical activity to proceed in comfort. Using this method, it has been demonstrated that performance capability can be maintained.

It is also considered important to provide maximum flexibility in providing localized heat, i.e. by directing the heat to specific targets. All of these concepts have been taken into account in the development of the present device.

PRIOR ART

The following prior art developments are considered relevant to the present invention.

U.S. Pat. No. 4,052,588, issued Oct. 4, 1977 to Nakamura et al., is directed to the micro-construction of an electric heater panel.

U.S. Pat. No. 3,961,157, issued Jun. 1, 1976 to Miller et al., describes a radiant heater construction which is in the form of a sandwich having the resistance heater in the centre.

U.S. Pat. No. 3,309,500, issued Mar. 14, 1967 to Reynolds is directed to a flat, rectangular heater adapted to be positioned in a vertical orientation inside the well of a desk.

U.S. Pat. No. 2,032,622, issued Mar. 3, 1936 to Le Guillou, describes a reflector with a reflective surface of which the contour can be altered by the user.

U.S. Pat. No. 2,479,425, issued Aug. 16, 1949 to Steingruber is directed to a stand-alone heater having a complex internal construction.

U.S. Pat. No. 2,612,825, issued Sep. 30, 1952 to McCann, describes a heating device for feet, the device being suggested for use on the floor within the well of a desk.

U.S. Pat. No. 2,613,308, La Mirand, discloses a radiant heater and tray, with means for supporting the same at an angle to the horizontal.

U.S. Pat. No. 2,715,668, issued Aug. 16, 1955 to Booker et al., is directed to a panel heater adapted to provide radiant heat.

The prior as described above tends to lack versatility and adaptability to the particular needs of individual users. For example, simple flat, rectangular panel heaters tend to give off heat uniformly, typically presenting the user with a choice between full on and full off (as controlled by a switch). It is generally not possible to direct the radiant heat from such a panel.

GENERAL DESCRIPTION OF THIS INVENTION

In view of the foregoing discussion of the prior art, it is an object of one aspect of this invention to provide a radiant panel heater of which at least a portion of the radiated heat can be selectively directed by the user. This is accomplished by providing a reflector flap which is hingedly mounted and capable of re-directing radiated heat.

It is an object of a further aspect of this invention to provide a radiant heater from which at least a portion of the radiant heat can be directed, for use within the well of a desk in order to provide localized heat for the worker, without requiring the entire space of the room to be uniformly heated.

Accordingly, this invention provides a heating unit for desks, comprising:

a frame, a substantially flat radiant heating surface supported by said frame, said surface having a periphery, an elongate, substantially U-shaped trough having a reflective inner surface, the trough being supported by said frame and located adjacent a portion of said periphery, an elongate heating element within and parallel to said trough, a reflector flap hingedly mounted with respect to the frame about a swivel axis adjacent the trough but remote from the heating surface, and disposed such that at least a portion of the radiant energy reflected out of said trough by said inner surface is re-reflected by said flap when it has a predetermined angulation with respect to said heating surface, and electrical means for energizing both the heating surface and the elongate heating element.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 2:
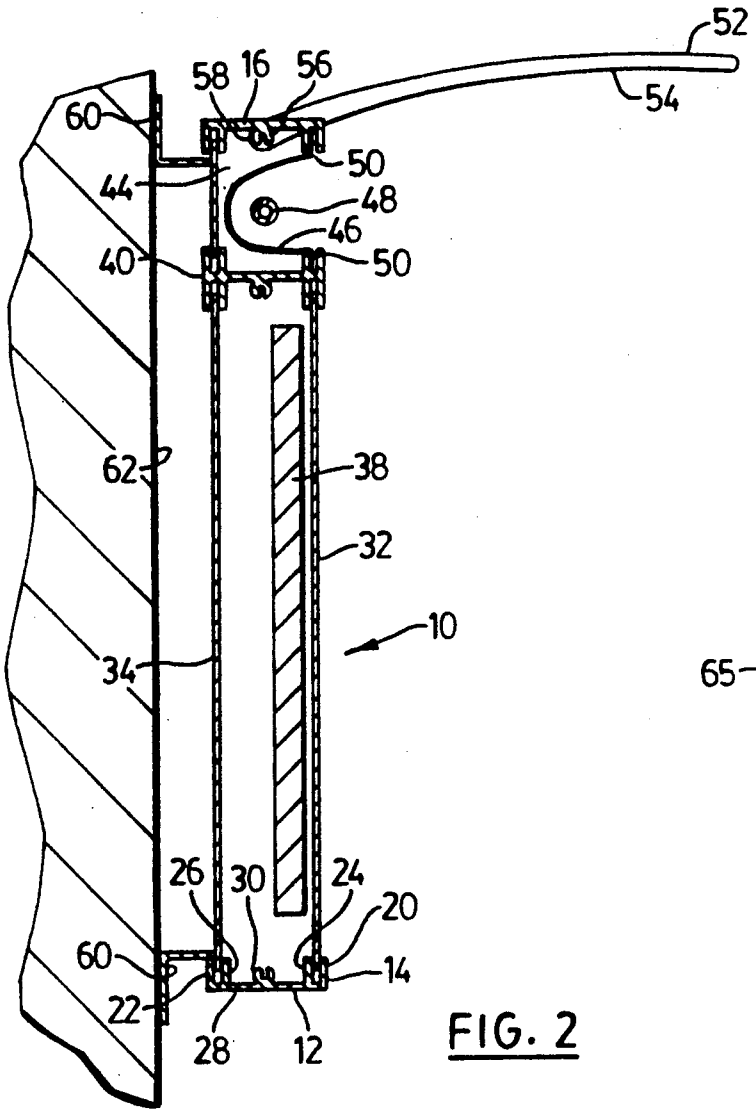
FIG. 2 is a cross-sectional view taken at the line 2—2 in FIG. 1.

As can be seen in the Figures, a radiant panel heater 10 includes a frame 12 which includes four external frame members 14, 15, 16 and 17. The frame members 14, 15 and 17 have the cross-sectional configuration shown at the bottom of FIG. 2, this configuration including a first outer flange 20, a second outer flange 22, a first inner flange 24, a second inner flange 26, a main wall member 28, and a projection 30 for receiving threaded fasteners and the like. As best seen in FIG. 2, a first external panel 32 is adapted to be received within the space defined between the outer and inner flanges 20 and 24, whereas a second exterior panel 34 is adapted to be received within the space between the flanges 22 and 26. Located within the space between the panels 32 and 34 is a radiant heater element 38 which may be of conventional construction, drawing electrical power and converting this to radiant heat.

Toward the top in FIG. 2, it will be noted that the panels 32 and 34 are received between spaced-apart flanges on an intermediate frame member 40 which is similar to the exterior frame member 12 except that it supports spaced-apart flanges extending in both directions.

Between the intermediate frame member 40 and the upper, external frame member 16 there is defined an elongate chamber 44 in which is disposed a specular heat deflector in the form of a trough having a substantially parabolic section, along with two marginal portions 50 which are received within the spaces between the rightward flanges of the frame members 40 and 16 (rightward as viewed in FIG. 2).

Mounted within and parallel to the deflector 46 is an elongate heating element 48, which may be a CALROD (TM) or any other suitable element adapted to give off radiant heat upon electrical energization.

The illustrated heater also includes a reflector flap 52 having a reflective surface 54. The flap 52 is hingedly mounted about a swivel axis 56 defined by the internal projection 58 of the frame member 16. The mounting of the flap 52 with respect to the frame member 16 is accomplished in such a way that friction will cause the flap 52 to remain in any desired angular position with respect to the remainder of the panel.

It will be noted in particular that the reflector flap 52 is located adjacent the trough defined by the deflector 46, but is remote from the radiant heating panel 38 and from the external panel 32 through which heat from the unit 38 is radiated.

It will further be noted that the flap 52 has a gentle curvature which is concave toward the panel 32, and that this section is uniform throughout the length of the flap 52. It will thus be understood that at least a portion of the radiant energy reflected from the deflector 46 (and originally generated by the heating element 48) will be re-reflected by the inner surface 54 of the flap 52, the particular angulation of the flap 52 determining the quantity of heat that is re-reflected.

Finally, it will be appreciated that the flap 52 is configured so as to allow it to be folded tightly against the heating surface while covering the trough, for ease of shipping, packaging and stacking.

In FIG. 2, it will be noted that the panel 10 includes L-shaped mounting flanges 60 by which the heating unit can be mounted to a vertical surface 62, for example the vertical surface inside the well of a desk.

Figure 1:
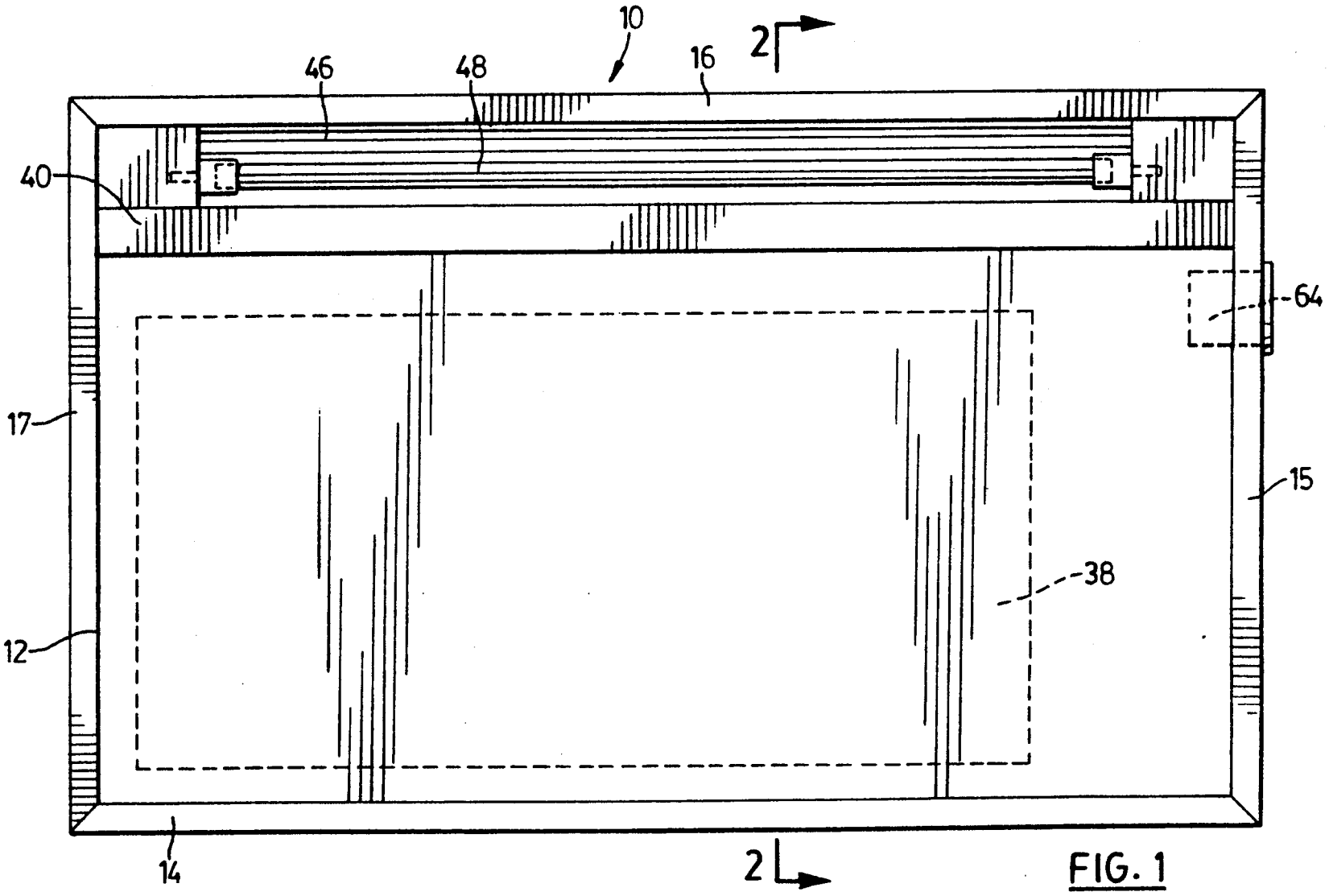
FIG. 1 is a top plan view of a heater constructed in accordance with this invention.

In FIG. 1, it can be seen that a side-mounted ground receptacle 64 is mounted along one edge of the unit.

Preferably the unit includes a rheostat or other equivalent unit by which the amount of heat generated by the unit can be controlled by the user.

Figure 3:
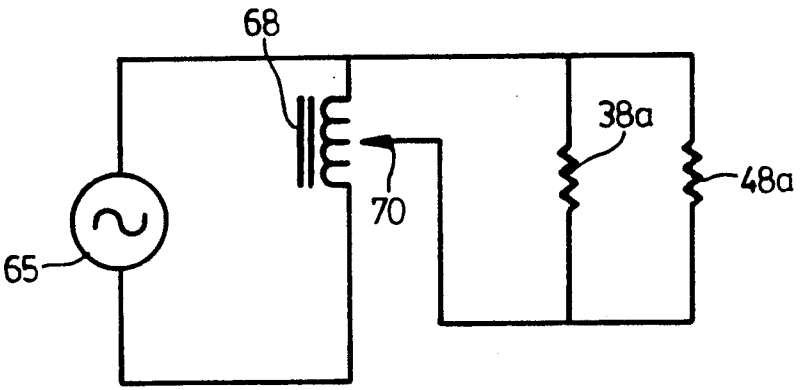
FIG. 3 is a simplified wiring diagram for the heater constructed in accordance with this invention.

A specific wiring diagram is shown in FIG. 3, in which a source 65 of AC power provides the input to an autotransformer 68, of which the output voltage can be adjusted by the sliding contact 70. As can be seen in FIG. 3, a resistance **48*a* representing the heating element 48 in FIG. 2, and a further resistance 38*a* representing the radiant heater element 38**, are wired in parallel. Of course, those skilled in the art will understand that alternative wiring diagrams could be provided.

It will thus be understood that the heating unit provided herein, when mounted in the well of a desk, permits office temperatures to be reduced while maintaining the necessary heat input to the user. This results in energy savings, improved productivity due to the cooler ambient air surrounding the upper portion of the user's body, and a perception of control over the work environment. Discomfort associated with lowered office air temperature is thus avoided.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A heating unit for desks, comprising: a frame,
- a substantially flat radiant heating surface supported by said frame, said surface having a periphery,
- an elongate, substantially U-shaped trough having a reflective inner surface, the trough being supported by said frame and located adjacent a portion of said periphery,
- an elongate heating element within and parallel to said trough,
- a reflector flap hingedly mounted with respect to the frame about a swivel axis adjacent the trough but remote from the heating surface, and disposed such that at least a portion of the radiant energy reflected out of said trough by said inner surface is re-reflected by said flap when it has a predetermined angulation with respect to said heating surface,
- and electrical means for energizing both the heating surface and the elongate heating element.

2. The unit claimed in claim 1, in which the flap has a uniform section taken perpendicular to the swivel axis, said section exhibiting a concave curvature toward said radiant heating surface.

3. The unit claimed in claim 2, in which the curvature is substantially cylindrical.

4. The unit claimed in claim 2, in which the flap is configured so as to allow it to be folded tightly against the heating surface, while covering the trough, for ease of shipping, packaging and stacking.

5. The unit claimed in claim 2, in which the trough has a substantially parabolic section taken perpendicular to the elongate heating element.

6. The unit claimed in claim 5, in which the radiant heating surface is substantially rectangular.

7. The unit claimed in claim 6, in which the flap is configured so as to allow it to be folded tightly against the heating surface, while covering the trough, for ease of shipping, packaging and stacking.

8. The unit claimed in claim 5, in which the flap is configured so as to allow it to be folded tightly against the heating surface, while covering the trough, for ease of shipping, packaging and stacking.

9. The unit claimed in claim 1, in which the trough has a substantially parabolic section taken perpendicular to the elongate heating element.

10. The unit claimed in claim 9, in which the flap is configured so as to allow it to be folded tightly against the heating surface, while covering the trough, for ease of shipping, packaging and stacking.

11. The unit claimed in claim 1, in which the radiant heating surface is substantially rectangular.

12. The unit claimed in claim 1, in which the flap is configured so as to allow it to be folded tightly against the heating surface, while covering the trough, for ease of shipping, packaging and stacking.

* * * * *